United States Patent [19]

Philippe

[11] Patent Number: 4,920,332

[45] Date of Patent: Apr. 24, 1990

[54] DIFFERENTIAL DETECTOR OF ACOUSTIC PRESSURE

[76] Inventor: Francois Philippe, Cai 33 Ave du Docteur Lefebure, 06270 Villeneuve Loubet, France

[21] Appl. No.: 265,249

[22] Filed: Oct. 31, 1988

[51] Int. Cl.[5] ..... G08B 13/20

[52] U.S. Cl. ..... 340/544; 340/566

[58] Field of Search ..... 340/501, 544, 566, 552, 340/553, 554; 367/93, 94

[56] References Cited

U.S. PATENT DOCUMENTS

| | | | |
|---|---|---|---|
| 4,134,109 | 1/1979 | McCormick et al. | 340/566 |
| 4,552,022 | 11/1985 | DuRand, III | 340/566 |
| 4,692,743 | 9/1987 | Holden et al. | 340/544 |
| 4,712,093 | 12/1987 | Reichel et al. | 340/566 |

*Primary Examiner*—Joseph A. Orsino

*Assistant Examiner*—Frank M. Scutch, III

*Attorney, Agent, or Firm*—Frishauf, Holtz, Goodman & Woodward

[57] ABSTRACT

An improved acoustic burglar alarm detects an aperiodic wave resulting from opening of a door or window, and adapts the threshold level, which discriminates between alarm events and non-alarm events, according to the ambient environment, thereby preventing wind from setting off an alarm, yet maintaining adequate sensitivity. The detection system features a microphone 1, preferably of electret type, a threshold comparator 5, a filtering circuit 7, a window comparator acting as a peak value detector, an integrator circuit 9, a voltage monitor 10, and an oscillator-counter 14. A monostable 16 triggers a relay 21 which sets off the alarm. A switch 15 permits selection between two alternate operating modes.

10 Claims, 3 Drawing Sheets

MIC.
AMP.
POT.
LOW - PASS FILTER
PEAK DET.
SWITCH
MODULATOR CIRCUIT
VOLTAGE MONITOR
LED
COMP.
OSC. KIT.
DET. SWITCH
MONOSTABLE
ACOUSTC VIBRATOR ALARM
+V
V1
V2
V3
V4

DIFFERENTIAL DETECTOR OF ACOUSTIC PRESSURE

The present invention concerns a differential detector of acoustic pressure for the detection of aperiodic waves following the opening of a door or a window in enclosed premisses, and more especially, such a detector carrying a microphone and means of setting a threshold level value.

The setting of this threshold level is automatic, and is conditioned by the stability or instability of the atmospheric mass within the premisses protected by the detector.

BACKGROUND

With the known detectors of this type, the output signal of the microphone is first of all amplified, then, generally speaking, compared with a set reference voltage in a comparator, the output of which can have two possible states according to the relative value of the signal coming from the microphone and the reference voltage.

These detectors activate the alarm when affected by an aperiodic compression wave, while they do not react to a periodic signal such as an audible sound, the monitoring being carried out especially on the shape and size of the signals picked up.

With these known differential detectors, as with previous state of the art equipment designed to warn of untimely openings of doors and windows in closed premisses, the threshold level must be set manually, case by case.

This setting is intricately linked, in practice, with any faults in the sealing of the site in question which might occur, and also with the extreme flexibility of some building materials used, which, in the case of a strong wind, give rise, due to a pushing effect or infiltration, to pressure variation within the premisses.

So as to avoid all risks of activating the alarm for reasons other than breaking and entering, the threshold level of these detectors should be set at a relatively high level, so that they do not take into account atmospheric disturbance which while being passing and random, is yet inevitable since it is conditioned by the presence of a strong wind. This setting is detrimental to the efficiency of the detector in calm weather.

THE INVENTION

The present invention overcomes this disadvantage by providing a differential detector of acoustic pressure in which the threshold level is automatically adapted according to the ambient environment. In fact, the detector decides for itself what threshold level it should adopt due to a permanent servo-control system concerning the atmosphere in which it is located.

To this effect, the subject of the invention is a differential detector of acoustic pressure for the detection of the opening of doors and windows in enclosed premisses, containing the means of picking up the wave produced by moving air masses when doors or windows are opened, and also containing the means of adapting the threshold level value in accordance with the ambient conditions. According to a preferential realisation, atmospheric disturbance is picked up by a microphone, the output signal of which is sent to a regulating means thus allowing the said threshold value to be altered.

With such a detector, the threshold level can consequently, due to the regulating means, be permanently set at its optimum value by the signal which is emitted from the microphone itself.

The result is that the aforementioned atmospheric disturbance is picked up as soon as it occurs and before it reaches the critical level for untimely activation so as to adjust the threshold level accordingly.

In a particular mode of realisation of this invention, the said regulating means contain a regulating loop which receives on input a signal coming from the microphone and the output of which is applied to an input of a comparator the other input of which receives another signal coming from the microphone.

The comparator therefore receives on the one hand, the signal which is indeed emitted from the microphone and may be amplified, and on the other hand, a variable threshold signal developed from the microphone signal.

The regulating loop of the signal emitted from the microphone includes several processing levels corresponding to the various phases of the analysis and shaping of the signal, which must be released in a manner which is intelligible to the system at the comparator level. Thus, the aforementioned loop may especially include a filtering circuit, a peak detector which gives the actual limits beyond which the alarm device would be activated if the threshold value were set, means for modulating the reference voltage due to the signal emitted from the microphone and previously filtered, and also a means for adapting the modulated signal to the input impedance of the comparator.

The device, according to the invention, can especially include comparative means for comparing the output level of the microphone to the said threshold value, an oscillator controlled by the said comparative means, counting means for counting the impulses outputted by the oscillator, and activaiton means for activating an alarm when the content of the counter goes beyond a predetermined value.

When the comparator output is considered as being live, i.e. the signal coming directly from the microphone is higher than the reference voltage, the load-side oscillator is activated, each impulse being counted by the counter. When the number of impulses counted reaches a predetermined value, the alarm is activated.

Such a detector does not indeed react to a periodic signal such as an audible sound, since in this case, the counter does not have the time, in a half-period of the signal, to reach the predetermined value which will activate the alarm.

BRIEF FIGURE DESCRIPTION

We will now describe the invention in greater detail, referring to the annexed diagrams for which:

FIG. 2 shows a possible variant of the device for which

Figure 3:
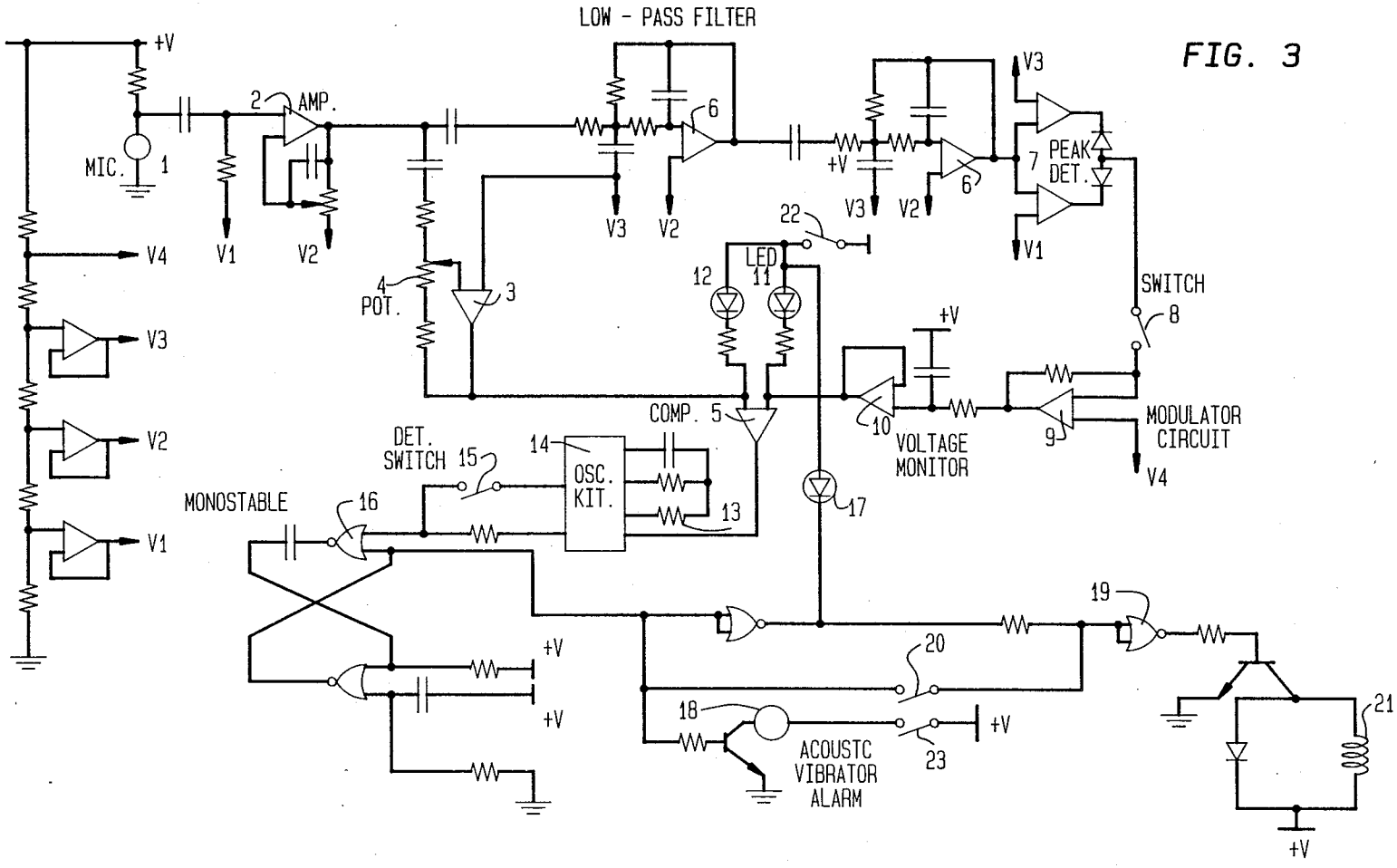

FIG. 3 gives a particular mode of realisation.

DETAILED DESCRIPTION

Figure 1:
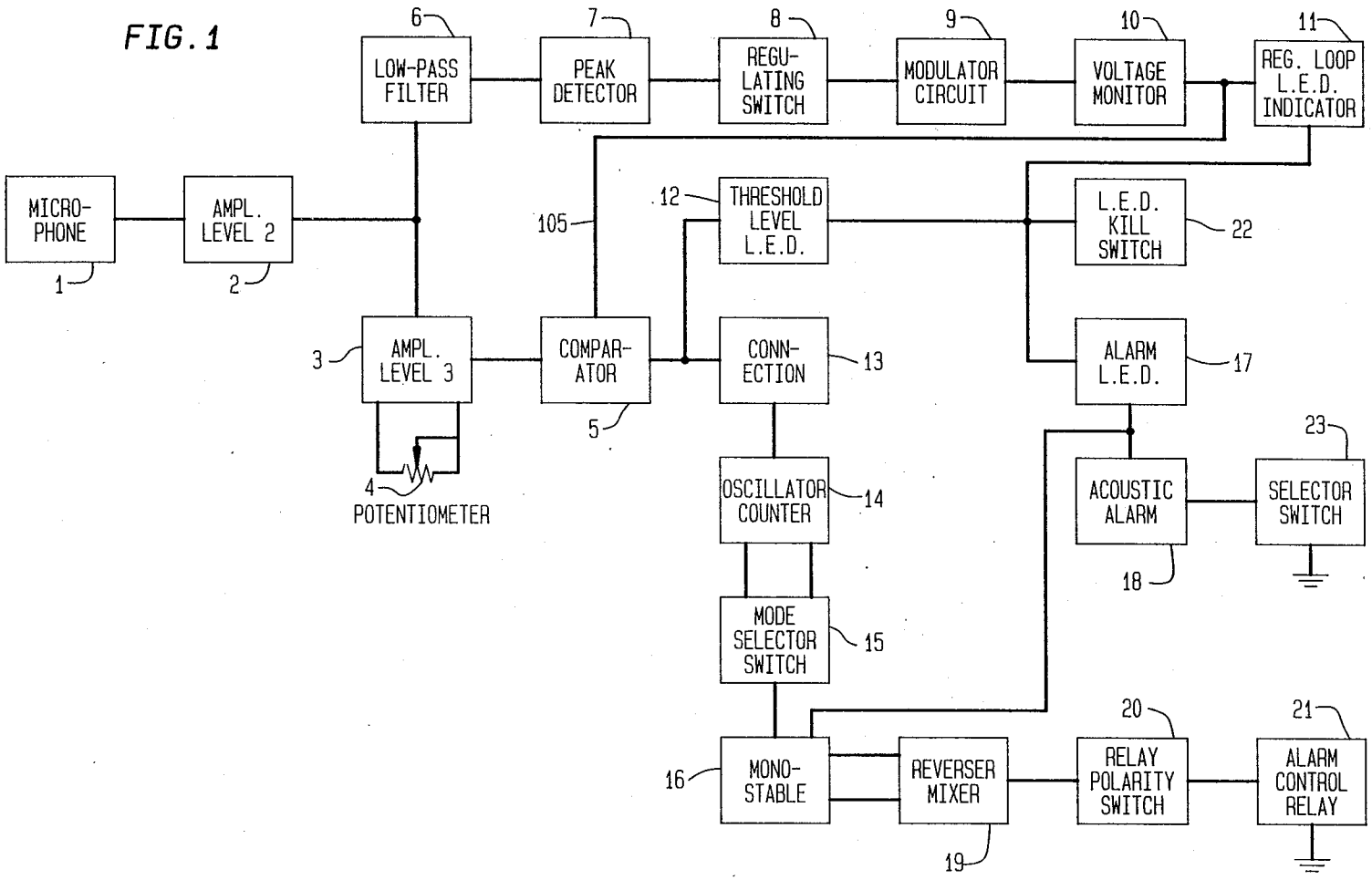
FIG. 1 represents a block diagram showing the design and architecture of the circuit.
Figure 2:
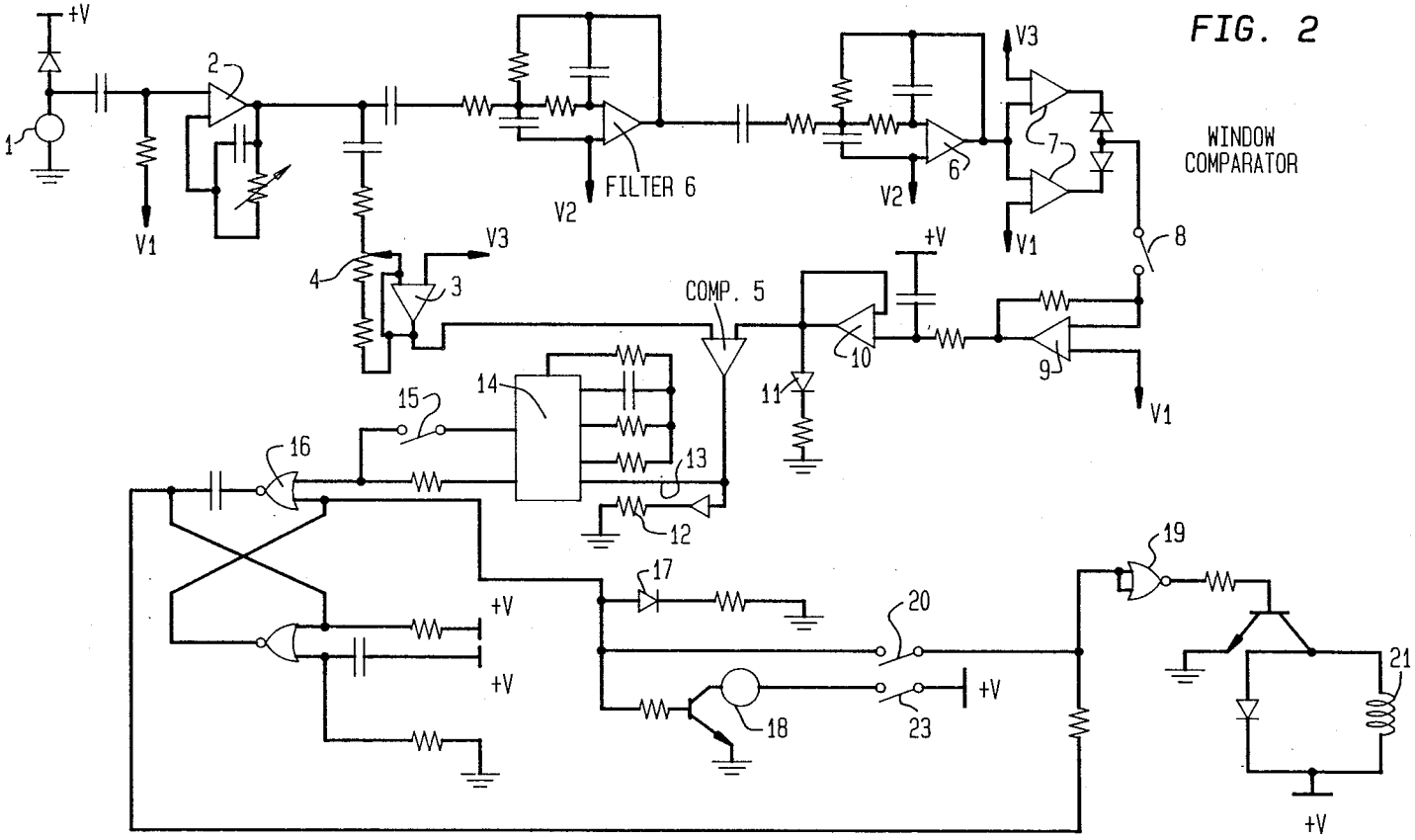

As FIG. 1 is a general diagram which focusses on the various parts of the circuit, it will not be described in detail, since the references can be found on FIGS. 2 and 3, which are indeed clearer. We will refer to FIG. 1 so as to have an overall view of the device which forms the subject of this invention. In the interest of clarity, we will begin an explanation of the device shown in FIG. 3.

With reference to FIG. 3, a microphone, of "electret" effect type, has its output linked to a threshold comparator 5 via a suitable two-level amplifier 2 and 3, level 3 can be adjusted by a potentiometer 4, operating so as to amplify more especially the signals corresponding to aperiodic compression waves. The output of the amplifier level 2 is moreover applied to the input of a low-pass 2-level amplifier filtering circuit 6.

The function of this filtering circuit is to hold only the ripple of the signal picked up by the microphone which is proportional to the extent of movement in the air masses within the site. It consequently eliminates the signal component which is due to an abrupt variation in pressure, such as that caused by the breaking of a glass pane, for example.

The output signal from the filtering circuit is applied to a peak circuit detector 7 realised in the form of a window comparator for which the two voltage references V1 and V3 are such that V3 is higher than V1.

The output of the peak circuit detector 7 is used to modulate the set voltage V1 in circuit 9 so as to make up the regulating signal, measured between V1 and ground.

The output of circuit 9 is then applied to a voltage circuit integrator the output of which is applied to a voltage monitor 10.

The voltage monitor 10 is finally used as the threshold level in the comparator 5.

The output of the comparator 5 is used to activate, through connection 13, an oscillator counter 14. As mentioned above, this oscillator-counter activates a monostable switch 16 once the predetermined number of impulses has been counted. During the switching time, the circuit 16 causes the excitation of a relay 21 controlling the means of alarm.

The operating polarity of the relay, positive or negative, can be selected by the user using a switch 20 and a reverser-mixer 19.

Consequently, atmospheric movements picked up by the microphone 1 are at the output of the filtering circuit 6 represented by variations in terms of voltage causing changes in the output state of the peak circuit detector 7. If the self-acting regulating switch 8 located on output for this circuit 7 is in the closed position, the voltage V1 applied at the positive input of the modulator circuit 9, is modulated by the output voltage of the filtering circuit if this voltage is no longer between V1 and V3.

A LED 11 located at the output of the voltage monitor 10 allows the operating state of the self-acting regulating loop to be controlled.

When an aperiodic wave caused by an opening or breaking-in is picked up by the microphone 1 then amplified by the amplifier 2, 3 and when it goes beyond the variable threshold level of the comparator 5, the comparator changes its logical state during a period proportional to the length of the wave in question. Another LED 12 which gauges the level is then activated.

If the length of the aperiodic wave detected is sufficient, the oscillator-counter 14 activates the alarm.

It should be noted that a detection switch 15 enables the operating mode of the detector to be chosen (shock or opening) by selecting the rate of oscillation required to activate the alarm.

The alarm signals constituted by a LED 17 and an acoustic vibrator 18 allow the operating of the detector to be monitored in the absence of the actual means of alarm, the said vibrator being moreover controlled by a selector switch 23.

While in the circuit shown in FIG. 3 three reference voltages rates were used, V1, V2 and V3 fixed by a bridge, V2 being centred in the interval (V1, V3) of 0.1 V, the variant proposed in FIG. 2 is based on a system of 4 set reference voltage rates V1 to V4.

The regulating loop is based on the same principle, including a low-pass 2-level filter (6) which is slightly modified concerning the input voltage, followed by a window comparator (7), a self-acting regulating switch (8) and an independent circuit adaptor (9). In this configuration, the reference voltage to be modulated in V4, the value of which is higher than V1, V2 and V3.

The filtering circuit (6), which takes into account the signal ripple picked up by the cell (1), amplifies the information filtered before being sent onto the detector level of the 2-threshold peak (7). These two reference voltage rates V1 and V3 form the limits beyond which the ripple variation caused by atmospheric disturbance or turbulence would inevitably lead to a change in the state of the comparator (5), via the amplifiers (2) and (3), thus activating the terminal alarm levels, if the threshold of the said comparator (5) were set and predetermined.

Three switch signal lights (11), (12) and (17) respectively indicate the working order of the self-acting regulating loop, the threshold level of the device and the activation of the terminal alarm levels. The first two, indicating the constant working order in a stand-by state, are respectively green and yellow in color. The signal light (17) which indicates an alert phase is red in color. A switch (22) can deactivate all the signal lights simultaneously.

Of course, one of the basic elements of the circuit thus described in the microphone, whose role is to pick up the significant signals. As we have seen, the waves which can be exploited by this type of device are aperiodic and consequently require pick-ups which will respond to extremely low frequencies, of 1 Hertz or even lower. The microphones should therefore be selected with utmost care, as the entire detector depends upon the quality of the initial pick-up. A suitable microphone is electret microphone model EM 80 B4 from the PRIMO company of Japan.

Diverse variants and modifications can still be made to the description above without straying from the framework or spirit of the invention.

I claim:

1. Differential detector of acoustic pressure, for detecting an aperiodic wave resulting from opening of a door or a window is closed premises while disregarding passing pressure variations caused by air leaks and flexing of building materials, including a microphone (1) and means for setting a threshold value level, comprising, means for regulating (6, 10) in order to vary said threshold value in accordance with the microphone output, including a regulating loop, including a filtering circuit (6), receiving as an input a signal coming from the microphone, and generating an output signal (105) filtered of said passing variations, and said detector further comprises a comparator (5) having two inputs, one receiving said regulating loop output signal (105), and the other receiving another signal coming from the microphone.

2. Detector according to claim 1, wherein said regulating loop comprises a peak detector circuit (7).

3. Detector according to claim 1, wherein said regulating loop comprises a peak detector circuit (7).

4. Detector according to claim 1, wherein said regulating loop comprises means (9) for modulating a voltage predetermined by a signal developed from the output signal of the microphone.

5. Detector according to claim 1, wherein said regulating loop comprises a circuit integrator.

6. Differential detector of acoustic pressure, for the detection of an aperiodic wave resulting from opening of a door or a window in closed premises, including a microphone (1) and means for setting a threshold value level, comprising, in accordance with the invention, means for regulating (6, 10) in order to vary said threshold value in accordance with the microphone output;

comparator means (5) for comparing the output level of the the microphone to the threshold value, an oscillator coupled to and controlled by said comparator means (5), a counter (14) coupled to, and counting output pulses from, the oscillator (4), and activating means (21) for activating an alarm when the content of the counter (14) goes beyond a predetermined value.

7. Detector according to claim 3, further comprising comparator means (5) for comparing the output level of the the microphone to the threshold value, an oscillator coupled to and controlled by said comparator means (5), a counter (14) coupled to, and counting output pulses from, the oscillator (4), and activating means (21) for activating an alarm when the content of the counter (14) goes beyond a predetermined value.

8. Detector according to claim 4, further comprising comparator means (5) for comparing the output level of the the microphone to the threshold value, an oscillator coupled to and controlled by said comparator means (5), a counter (14) coupled to, and counting output pulses from, the oscillator (4), and activating means (21) for activating an alarm when the content of the counter (14) goes beyond a predetermined value.

9. Detector according to claim 1, wherein said comparator (5) compares the output level of the the microphone to the threshold value, and further comprising an oscillator coupled to and controlled by said comparator (5), a counter (14) coupled to, and counting output pulses from, the oscillator (4), and activating means (21) for activating an alarm when the content of the counter (14) goes beyond a predetermined value.

10. Detector according to claim 5, further comprising comparator means (5) for comparing the output level of the the microphone to the threshold value, an oscillator coupled to and controlled by said comparator means (5), a counter (14) coupled to, and counting output pulses from, the oscillator (4), and activating means (21) for activating an alarm when the content of the counter (14) goes beyond a predetermined value.

* * * * *